United States Patent [19]

Richardson

[11] 3,952,808

[45] Apr. 27, 1976

[54] FIRE PROTECTION SYSTEMS

[75] Inventor: Edward Gregory Richardson, Bathford, England

[73] Assignee: National Research Development Corporation, London, England

[22] Filed: Jan. 21, 1975

[21] Appl. No.: 542,676

[30] Foreign Application Priority Data

Jan. 23, 1974 United Kingdom ..... 3193/74
Mar. 15, 1974 United Kingdom ..... 11608/74

[52] U.S. Cl. ..... 169/61; 169/16; 340/237 S

[51] Int. Cl.[2] ..... A62C 37/04

[58] Field of Search ..... 169/54, 60, 61, 5, 11, 169/26, 70, 16; 340/418, 237 S

[56] References Cited

UNITED STATES PATENTS

| | | | |
|---|---|---|---|
| 2,311,374 | 2/1943 | Farmer et al. | 169/61 |
| 3,703,930 | 11/1972 | Lofstrand et al. | 169/60 |
| 3,826,180 | 7/1974 | Hayashi | 169/61 X |
| 3,865,192 | 2/1975 | Dunphy | 169/61 |

*Primary Examiner*—Evon C. Blunk
*Assistant Examiner*—Michael Mar
*Attorney, Agent, or Firm*—Cameron, Kerkam, Sutton, Stowell & Stowell

[57] ABSTRACT

A protection system for use in the detection of smoke etc., from one or more of a plurality of locations and the subsequent release of an extinguishant into these locations comprising a control unit including pump, sensing equipment and extinguishant in fluid connection with a plurality of sensing tubes in a pre-arranged distribution network with the open ends of the tubes extending into the locations to be protected; during operation air from the locations being protected is sucked through the sensing tube network and into the control unit where it is analyzed by the sensing equipment. Upon detection of contaminated air the sensing side of the system is sealed off and extinguishant automatically made to flow through the same distribution network to the location being protected.

10 Claims, 6 Drawing Figures

FIRE PROTECTION SYSTEMS

This invention relates to improvements in fire protection systems and in particular to smoke detection and fire prevention systems. In general, but not exclusively, the invention relates to a protection system for use in the simultaneous protection of several areas or locations each containing or housing for example units or modules of data processing equipment where physical observation and access is invariably difficult if not impossible. The invention further offers the capability of protection in specialised environments where the sensing and immediate warning of radiation, inflammable gases etc in addition to the sensing of smoke is desired.

The invention is particularly suitable for all types of smaller installations ranging from racks of individual cabinets to complete rooms.

Throughout this specification any general reference to the terms smoke detection or smoke sensing are to be read also as references to the sensing of other recordable environments such as, for example, the presence of radiation or inflammable gases.

Generally speaking smoke detection/fire protection systems of the type described are custom-built and are consequently individual and relatively expensive installations. In addition conventional protection systems are usually provided in two distinct and separate categories, smoke detection and fire extinguishing. The protection system of the invention specifically fills an existing technical gap in the protection of explosive weapons during their testing and for which no conventional system is practicable. It also fills a general economic gap in the protection of for example electronic consoles where conventional protection systems are practicable but are too expensive to allow widespread coverage.

According to the present invention a protection system capable of use for the detection of smoke from one or more of a plurality of locations and the subsequent release of an extinguishant into these locations includes a main tube in fluid connection between on the one side a plurality of sensing tubes in a pre-arranged distribution network with the open ends of the tubes of the network extending into the locations to be protected and the open end of each tube containing a restrictor nozzle to restrict and control the air-flow through the network, and on the other side a control unit including a pump arranged to draw air through the tube network and the main tube and a smoke detector arranged to sample such air and provide warning of the presence of smoke in the sampled air.

Preferably the pre-arranged distribution network of sensing tubes is built up of a succession of bifurcations of the main tube i.e. the main tube is bifurcated into two branch tubes each of which may themselves in turn be bifurcated into two further branch tubes. Preferably the branch tubes are built up in a symmetrical pattern about the main tube to create a balanced network, the branch tubes being disposed relative to their "parent" tubes in a succession of Y- or T-junctions.

In an arrangement of the invention offering a complete protection system the control unit includes in addition to the pump and smoke detector a solenoid or other like valve which upon activation from the smoke detector will operate to seal off the smoke detection capability and, if required, initiate the release of a suitable extinguishant through the same main tube and distribution network as that utilised for the detection operation of the protection system. The extinguishant, which might conveniently be BCF (Bromochlorodifluoromethane), is connected into the main tube on the tube network side of the pump and solenoid valves.

Additional sensing detectors may conveniently be included in the control unit to detect for example inflammable gases or radiation. Such detectors may be arranged simply in series with the smoke detector and the pump.

An attractive feature of the protection system of the invention is that the control unit with its associated equipment including pump, detectors, extinguishants and alarm systems may be located some considerable distance away from the locations being protected.

Additional supplies of extinguishants may be provided and may be associated with the main tube, or separately fed, to be operated automatically upon activation of the system to continue to supply extinguishants when the primary supply is exhausted or where it is desired to provide extinguishants at a greater flow rate. Alternatively the additional supplies of extinguishants may only be released by the manual operation of a reserve switch located on the control unit, which reserve switch can only be operated after activation of the main system.

Remote display systems may also be provided which are connected electrically or otherwise to the control units and which can reproduce all necessary warning signals and operational capability ie release of additional extinguishants, of the control unit.

When the protection system of the invention is operating to protect a relatively large room or a large number of individual cabinets the air received at the main sensor unit (where the detection of smoke, radiation etc is conducted) is drawn from several different locations and consequently the sensitivity of the sensor is less than for example if all of the air being sensed were drawn from one location. A further embodiment of the invention therefore includes a solenoid or like valve located in each of the individual sensing tubes and a multi-zone detector device having means whereby the solenoid or like valve may be operated sequentially to allow at any one time air from only one of the locations being protected to flow to the main smoke sensor.

The multi-zone detector device may conveniently include a variable period stepping electrical switch electrically connected with the solenoid valves and arranged to continuously and sequentially open each of the solenoid valves in turn for a pre-determined period of time.

A reasonable period of time for sensing air from any one particular location is considered to be in the region of 30–50 seconds.

Several embodiments of the invention will now be described by way of example only and with reference to the accompanying drawings in which FIG. 1 illustrates schematically a typical protection system of the invention.

Figure 1:
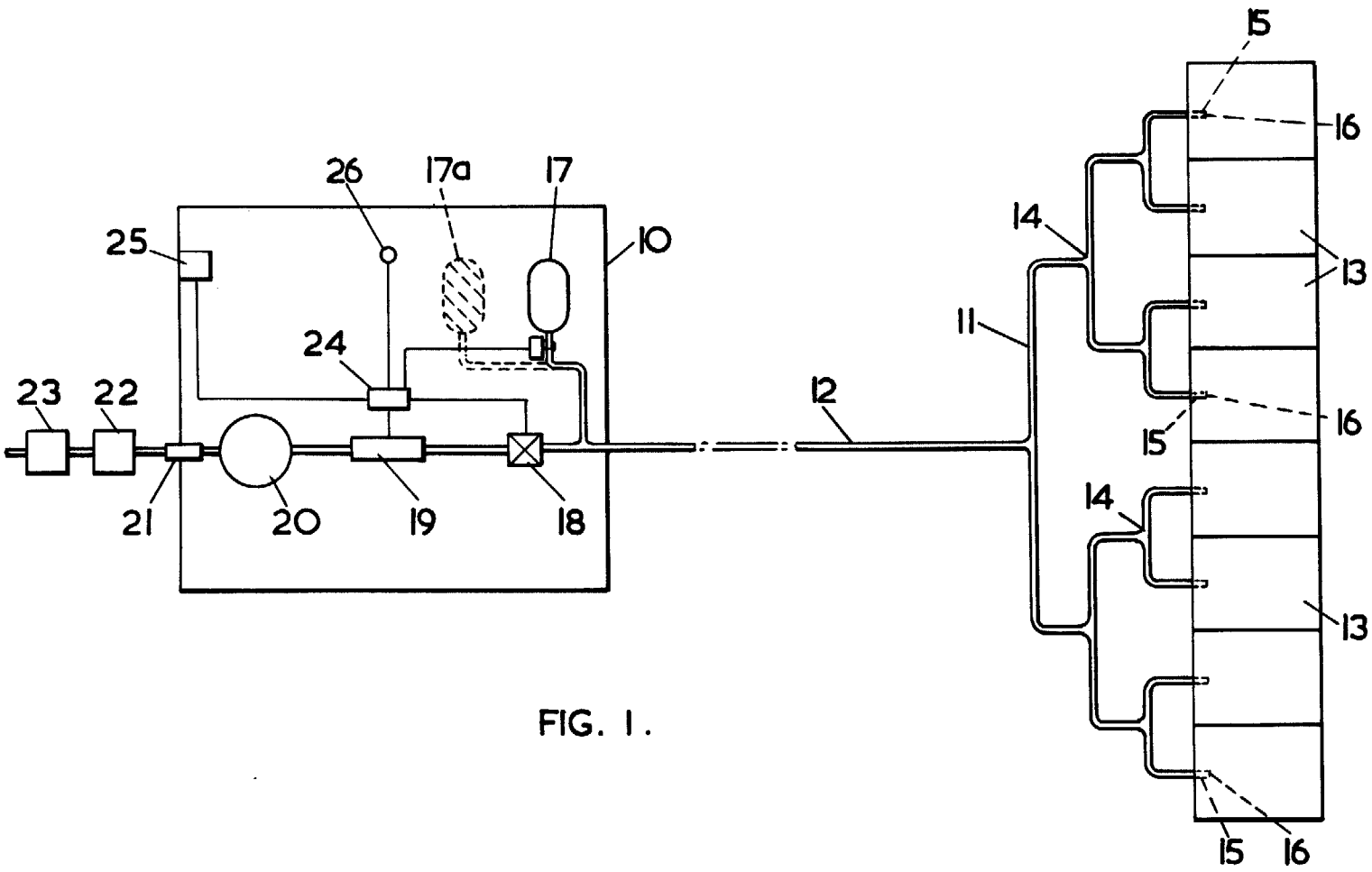

Referring to FIG. 1, a main control unit 10 is connected with a distribution network of sensing tubes 11 by a ¼ inch bore main tube 12 which can be up to 120 feet in length (or even longer if a longer response time can be tolerated). The system illustrated is arranged to protect electronic equipment in 8 cabinets 13.

The network of sensing tubes 11 is made up to 3/16 or ¼ inch bore tubes arranged symetrically about the main tube 12. The network as a whole is designed and constructed with bifurcation junctions 14 (which may be of Y- or T-form) to provide a balanced system in which a steady suction pressure in the main tube 12 will produce substantially equal suction pressures at the open ends 15 of the network tubes 11. Each open end 15 which extends into the cabinet 13 it is designed to protect, is provided with a 3/32 inch internal diameter restrictor nozzle 16 to reduce the total air flowing through the tube network 11 and to achieve a further balance of the system.

The main control unit 10 is self-contained and houses a BCF extinguishant bottle 17, a solenoid valve 18, a smoke detector 19 and a vacuum pump 20 each arranged in series along and connected with the main tube 12. Air drawn through the system by the vacuum pump 20 is exhausted through an exhaust connector nozzle 21 to which, if desired, additional add-on sensors such as an inflammable gas detector 22 and a radiation detector 23 can also be connected.

An electrical relay 24 operable by the smoke detector 19 controls sequentially the operation of the solenoid valve 18, release of the extinguishant from the extinguishant bottle 17, and activation of an alarm system 25.

During operation of the protection system, the vacuum pump 20 is continually drawing air from the cabinets 13 through the network of tubes 11, the main tube 12, the open solenoid valve 18 and the smoke detector 19.

In the event of, for example, cables over-heating or a fire occurring within any of the cabinets 13, the smoke concentration will rapidly build up and although the smoke laden sample from the affected cabinet 13 is diluted with clean air from the remaining unaffected cabinets 13, the concentration is sufficient to activate the smoke detector 19 in a matter of 3 to 20 seconds. This compares with a normal reaction time for conventional open smoke detectors which is of the order of 1½ to 2½ minutes. (Refer below to the description of FIG. 6 in which there is described a method whereby the problems of dilution can be avoided in certain cases where the time of warning of, for example, a fire is not so critical).

As soon as smoke is detected by the smoke detector 19 the smoke sensing side of the system is sealed off by the operation of the electrical relay 24 which initially closes the solenoid valve 18 and then initiates release of the BCF extinguishant from the extinguishant bottle 17. The BCF extinguishant is then forced at high pressure along the main tube 12 and the network of sensing tubes 11 into the cabinet 13. As BCF is a relatively inert and harmless gas, even to bare electronics on power, no damage will result from the injection of the BCF into the unaffected cabinets. The cooling effects of BCF is minimal as compared to, for example, $CO_2$.

Additional functions of the electrical relay 24 are to activate the alarm system 25 and also to isolate all power being fed into the cabinets 13 thus removing the cause of the fire and possible re-start after the extinguishant flow has been completed.

The BCF extinguishant bottles 17 are available commercially and contain 12 lbs. of BCF extinguishant. With the system described this is sufficient to provide a controlled flow of BCF into the cabinets 13 lasting 10 seconds or more and so avoiding pressurisation of the cabinets 13. A second bottle 17 A of BCF extinguishant may be provided within the main control unit can and may be so connected with the main bottle 17 that it will automatically release its charge as the main bottle 17 is fired. Alternatively, the second or reserve BCF extinguishant bottle 17A may be connected with a reserve drench button 26 which is manually operable only after a special interlock has been released following activation of the main protection system.

Figure 2:
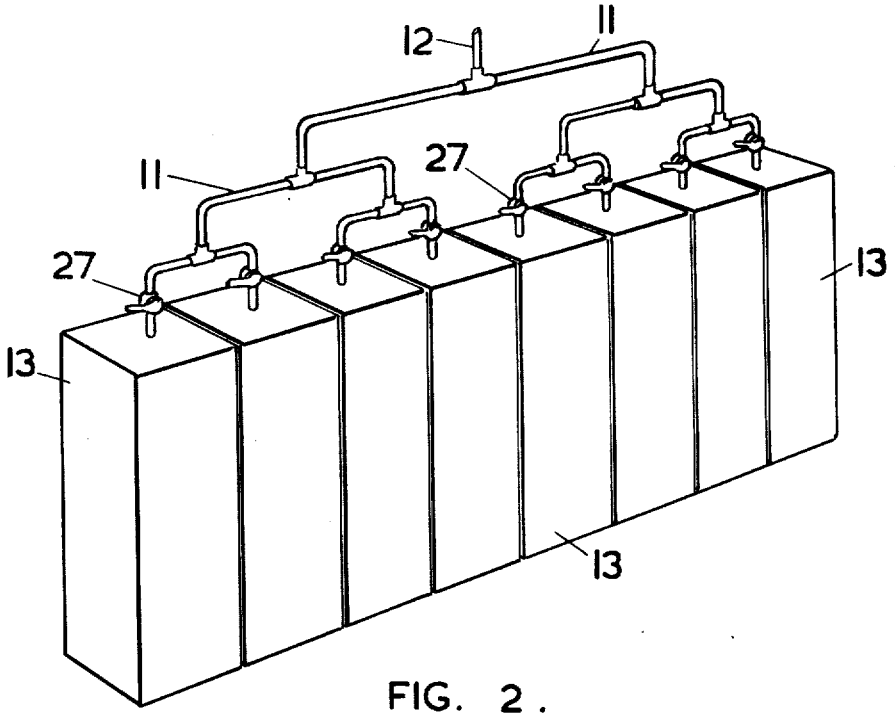
FIG. 2 illustrates a detail of the distribution network of sensing tubes of FIG. 1 as they might be used in the protection of equipment cabinets.

A particular embodiment of the system of the system FIG. 1 is shown in FIG. 2 and provides taps or valves 27 which are located in the network sensing tubes 11 at a point just before entry of the network sensing tubes 11 into the cabinets 13. The taps 27 allow any of the cabinets 13 to be temporarily isolated from the general protection system should they, for example, be empty or contain equipment that is being worked upon. Where only a maximum of eight cabinets need to be protected at any time, the use of taps can allow more than this number to be introduced into the system.

Figure 3:
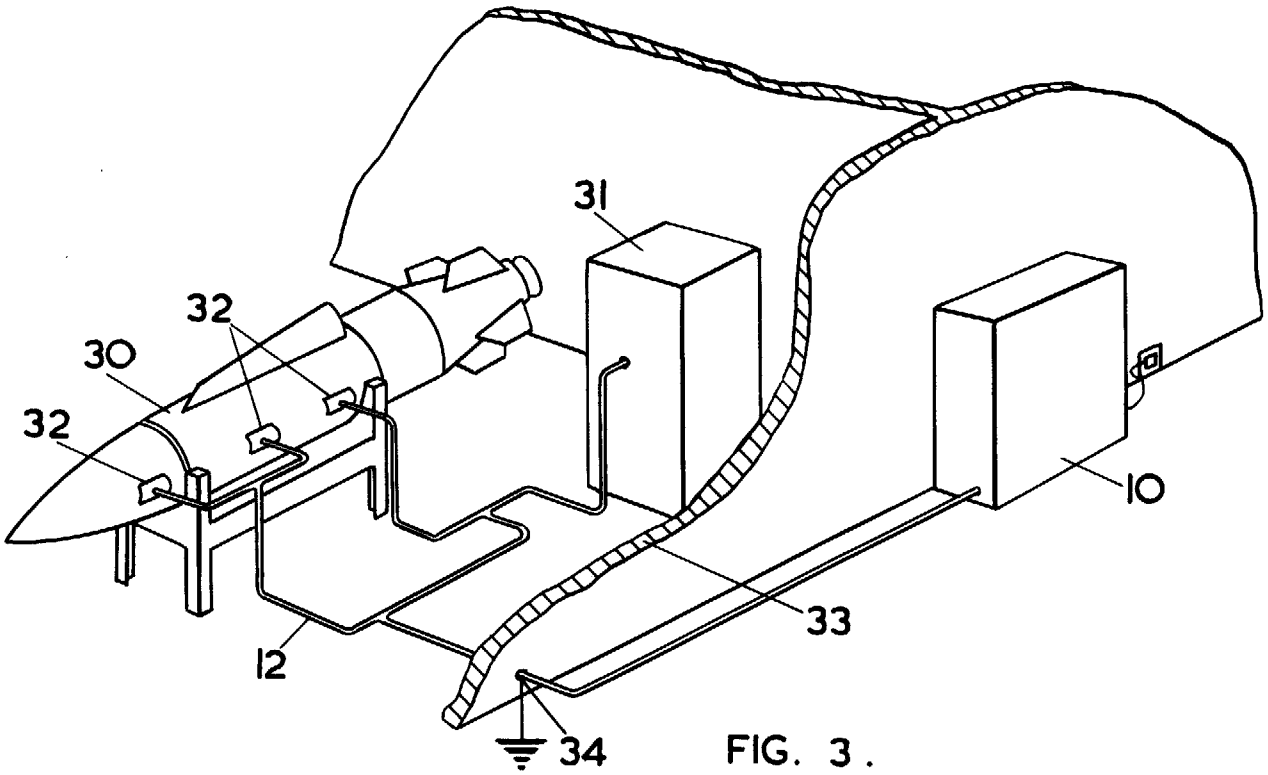
FIG. 3 illustrates schematically a typical and complete protection system as applied to a weapon and associated test equipment.

Considering now FIG. 3 an adaption of the complete protection system is shown as used for the protection of a weapon 30 and its associated test equipment.

In this arrangement, it will be seen that protection is being afforded to 3 compartments 32 of the weapon 30 and 1 cabinet housing the associated test equipment 31. The main tube 12 is fed out through the wall 33 of the test building and out into the main control unit 10 which is located outside the test area. The main tube 12 is earthed at 34 to the test building earth at the point where it passes through the wall 33.

The protection system of the invention is ideally suited to the overall protection of weapons since the problems encountered when testing sophisticated explosive weapon systems (particularly during the periods when high electrical power is applied) are considerably more complex than those usually found in other equipments. Weapon testing conventionally is carried out remotely in the interests of personnel safety. Electrical fires within the weapon are the most likely hazard and at the present time, there are no practical means of indicating that such an internal fire could have started. Furthermore there are no practical methods of actually getting inside a weapon to fight such a fire. There is inadequate space to locate smoke detectors inside a weapon and conventional smoke detectors placed outside a weapon would generally provide too slow a response. It is also highly desirable to reduce the amount of electrical equipment such as smoke detectors in close proximity with explosives. The protection system described therefore provides ideally for the weapon and associated test equipment environment and allows for the placing of extinguishant precisely where it is needed. Experiments have shown that one 12*lb* BCF extinguishant bottle 17 is normally quite sufficient to perform a several hundred per cent over-kill on even the largest weapon.

Figure 4:
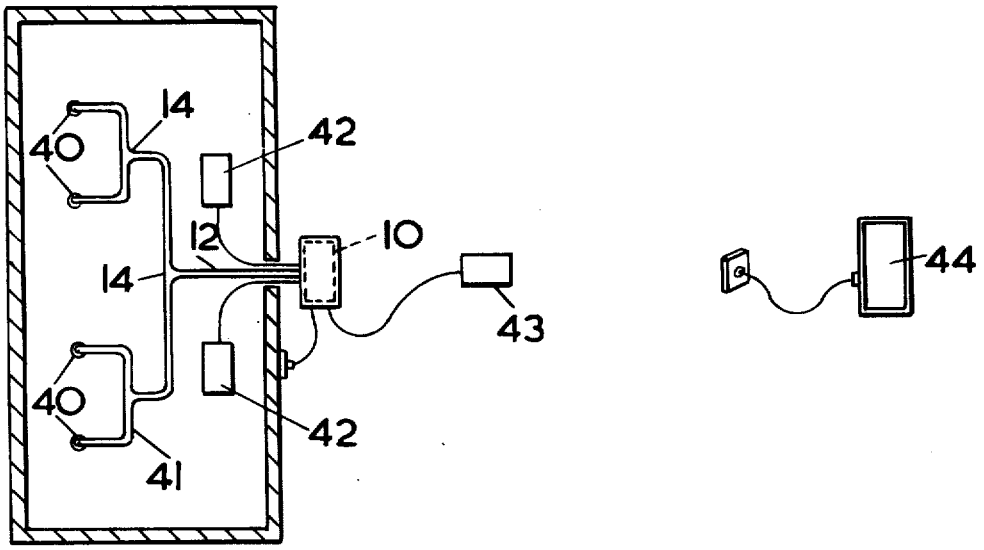
FIG. 4 illustrates schematically a typical protection system for a warehouse.

FIG. 4 shows a typical protection system designed in accordance with the invention for a warehouse or other room which may be relatively isolated. There are provided air sampling points 40 connected with the main tube 12 by flexible hose 41 the system being balanced through the bifurcation junctions 14.

Since the capacity of the single system would be insufficient to successfully or quickly control and extinguish a fire in a large enclosure such as a warehouse, it is desirable to provide additional add-on units 42 containing additional supplies of extinguishant and which may be readily activitated by an electrical signal from the main control unit 10 to release their extinguishant.

The main control unit 10 can be connected into normal fire alarm circuits or alternatively a remote control display unit 43 in electrical connection with the main control unit 10 may be provided. If the control point is some considerable distance from the protection system installation eg half to three-quarters of a mile, and provided the power supply to both the main control unit 10 and the control points are of the same transformer and phase then alarm signals from the main control unit 10 can be transmitted to the control point 44 by means of a mains/intercom unit. Alternative known signal transmission devices may similarly be employed.

Figure 5:
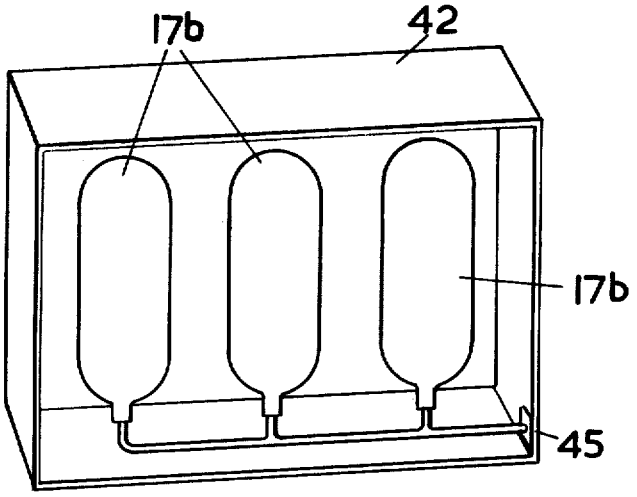
FIG. 5 illustrates an add-on extinguishant unit of FIG. 4.

A typical add-on extinguishant unit 42 is shown in FIG. 5 and contains 3 121*b* BCF extinguishant bottles 17B connected in series to a high flow outlet 45. It has been found that 3 such add-on units 42 can adequately protect a volume of up to 6,000 cubic feet.

Figure 6:
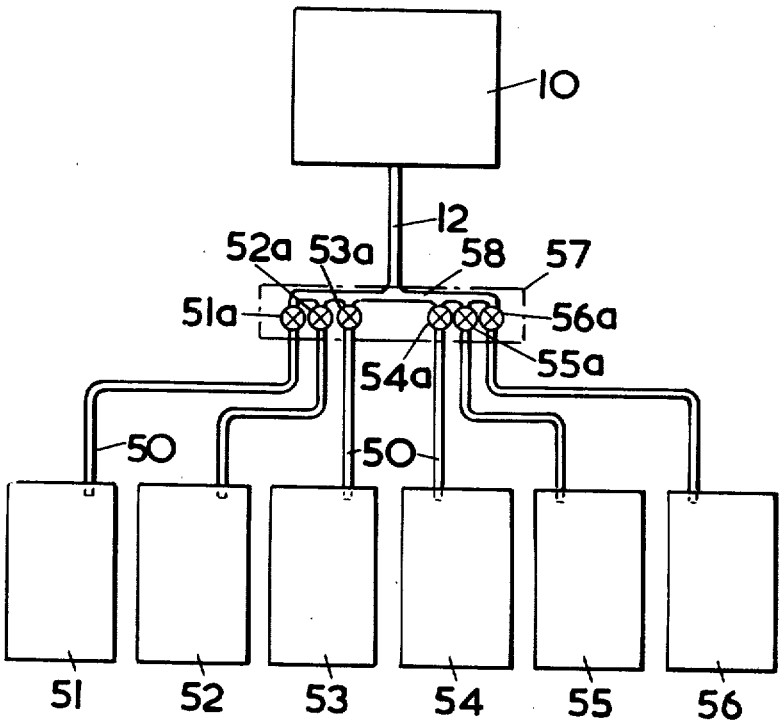
FIG. 6 illustrates schematically a method of sequentially sampling air from different locations in a protection system of the invention.

Referring now to FIG. 6 there is illustrated schematically a system whereby air from 6 different locations may be sensed sequentially rather than in combination.

Sensing tubes 50 from locations 51, 52, 53, 54, 55 and 56 are fed to a multi-zone detector device 57 where they join into a common feed tube 58 feeding a main control unit 10 via a main tube 12. The main control unit 10 is as described above and includes suitable smoke, radiation etc detectors, vacuum pump, and associated equipment. Each sensing tube 50 can be further divided into two or four nozzles in each location.

Located in each of the sensing tubes 50 at a point before they enter the feeder tube 58 are solenoid valves 51*a*, 52*a*, 53*a*, 54*a*, 55*a*, and 56*a* which are electrically connected with and operable by a stepping electrical switch (not shown) which functions to open sequentially in a pre-determined order and for a pre-determined time the solenoid valves 51*a*, 52*a*, 53*a*, 54*a*, 55*a* and 56*a*.

In operation the stepping electrical switch (not shown) is set, for example, to a 40 second period and the main control unit 10 is activated to switch the protection system on. Air is then drown for example from location 51 through its sensing tube 50 and through the open solenoid valve 51*a* into the feeder tube 58 and main tube 12 and on into the sensor equipment within the main control unit 10. Air is drawn from location 51 for a period of 40 seconds after which time the stepping electrical switch automatically causes the solenoid valve 51*a* to be closed and, for example, the solenoid valve 52*a* to be opened. For the next 40 seconds air is drawn through the sensing tube 50 from location 52. This sequence is repeated until each of the solenoid valves 53*a*, 54*a*, 55*a* and 56*a* have in turn been opened for a period of 40 seconds. It will be seen therefore tha whereas the main control unit 10 has been sampling and sensing air continuously the air has been drawn ir turn from the six locations 51, 52, 53, 54, 55 and 56.

The advantage of this system is readily apparent ir that for larger area protection the air from each of the locations is sampled in turn and independently of the air from the other locations thereby allowing a far more sensitive detection than would be possible if the ai passing through the sensors was a mixture of samplec air from all of the locations. The system can be usec efficiently to protect for example six locations of abou 6,000 cubic feet or a combined volume of approxi mately 36,000 cubic feet.

It will be fully appreciated that the general features o the system as described can be modified to suit particu lar needs and the figures quoted by way of example are in no way limiting.

Once smoke, for example, has been detected the location from which the contaminated air has beer drawn will be indicated by the multi-zone detecto device and the supply of extinguishant to that locatior may be automatically initiated. It is likely that the ex tinguishant stored in the main control unit 10 would b insufficient to successfully extinguish the fire and s special additional sources of extinguishants (ie add-o units 42) would normally be provided at each location These would be activated by a signal from the multi zone detector device 57.

An important general feature of the invention is tha the main control unit 10 and its associated detector may be positioned outside and remote from the area t be protected and can therefore not act as a hazard i itself.

It will be appreciated that the embodiments de scribed are by way of example only and as such in n way limit the scope of the invention. Further, it will b apparent to the artisan skilled in the art that he ma build up specialist protection systems to any specifi design using the standardized equipment of the inven tion.

I claim:

1. A protection system for use in the detection c smoke from one or more of a plurality of locations an the subsequent release of an extinguishant into thes locations including a main tube, a plurality of sensin tubes in a pre-arranged distribution network in flui connection with one end of said main tube and with th open ends of said tubes of said network extending int said locations to be protected, each of said sensin tubes containing a restrictor nozzle in its open end t restrict and control flow through said network, a cor trol unit in fluid connection with the other end of sai main tube and including a pump arranged to draw a through said tube network and said main tube, a smok detector arranged to sample said air and provide warn ing of the presence of smoke in said sampled air, source of extinguishant, and valve means which upc activation from said smoke detector will operate to se off the smoke detection capability and initiate the r lease of extinguishant through the same said main tut and distribution network as that utilized for the dete tion operation of the system.

2. A protection system according to claim 1 in whic said pre-arranged distribution network of sensing tub is built up of a succession of bifurcations of said ma tube.

3. A protection system according to claim 1 including valve means located in each of the individual sensing tubes and a multi-zone detector device having means whereby said valve means may be operated sequentially to allow at any one time air from only one of said locations being protected to flow through said main tube and to said smoke detector.

4. A protection system according to claim 3 in which said multi-zone detector device includes a variable period stepping electrical switch, said switch being electrically connected with said valve means and arranged to continuously and sequentially open each of said valve means in turn for a pre-determined period of time.

5. A protection system according to claim 4 in which the period of time for sensing air from any one particular location is in the range 30–50 seconds.

6. A protection system according to claim 1 in which said control unit includes additional sensing detectors to detect inflammable gases or radiation.

7. A protection system according to claim 1 in which said control unit including pump, detectors, and extinguishants is located some considerable distance away from the locations being protected.

8. A protection system according to claim 1 in which there is provided an additional supply of extinguishant which in use is released automatically upon activation of said system to supply additional extinguishant when the primary supply is exhausted or when a supply of extinguishant at greater flow rates is required.

9. A protection system according to claim 8 in which said additional supply of extinguishant may only be released by the manual operation of a reserve switch located in the control unit and which can only be operated after activation of said system.

10. A protection system according to claim 1 in which there are provided remote display systems which are connected to said control unit and which can reproduce warning signals and operational capability of the main control unit.

* * * * *